US009022803B2

(12) United States Patent
Terajima

(10) Patent No.: US 9,022,803 B2
(45) Date of Patent: May 5, 2015

(54) CONNECTOR AND CONNECTOR ASSEMBLY

(71) Applicant: Tyco Electronics Japan G.K., Kanagawa-ken (JP)

(72) Inventor: Keita Terajima, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 89 days.

(21) Appl. No.: 13/656,044

(22) Filed: Oct. 19, 2012

(65) Prior Publication Data

US 2013/0178098 A1 Jul. 11, 2013

(30) Foreign Application Priority Data

Oct. 19, 2011 (JP) ..... 2011-229680

(51) Int. Cl.

| | |
|---|---|
| ***H01R 13/40*** | (2006.01) |
| ***H01R 13/52*** | (2006.01) |
| ***H01R 13/62*** | (2006.01) |
| ***H01R 24/60*** | (2011.01) |

(52) U.S. Cl.

CPC ..... *H01R 24/60* (2013.01); *H01R 13/521* (2013.01); *H01R 13/62* (2013.01)

(58) Field of Classification Search

USPC ..... 439/587, 589, 350, 353–357

See application file for complete search history.

(56) References Cited

U.S. PATENT DOCUMENTS

| | | | | |
|---|---|---|---|---|
| 3,941,447 | A | 3/1976 | Hargrave et al. | |
| 4,449,776 | A * | 5/1984 | Carmo et al. | 439/350 |
| 4,669,804 | A * | 6/1987 | Munroe | 439/398 |
| 2010/0033268 | A1 | 2/2010 | Iizuka et al. | |

FOREIGN PATENT DOCUMENTS

| | | |
|---|---|---|
| GB | 2268640 A | 12/1994 |
| JP | 2003-179457 | 6/2003 |
| WO | 2009014574 A1 | 1/2009 |

OTHER PUBLICATIONS

European Search Report, dated Jan. 2, 2013, 7 pages.

* cited by examiner

*Primary Examiner* — Jean F Duverne
(74) *Attorney, Agent, or Firm* — Barley Snyder

(57) ABSTRACT

The connector includes a pin contact, a housing, a sealing member, and a limitation member. The pin contact is rod-shaped and makes contact with a mating contact. The housing includes a through hole through which the pin contact extends from a top of the housing to a bottom of the housing, with parts of the pin contact protruding from both of the top of the housing and the bottom of the housing. The sealing member seals the space between through hole and the pin contact. The limitation member applies a reaction force against a force experienced by the pin contact through a contact of the mating contact, so as to limit inclination of the pin contact.

12 Claims, 5 Drawing Sheets

CONNECTOR AND CONNECTOR ASSEMBLY

CROSS-REFERENCE TO RELATED APPLICATIONS

This application claims the benefit of the filing date under 35 U.S.C. §119(a)-(d) of Japanese Patent Application No. 2011-229680, filed Oct. 19, 2011.

FIELD OF THE INVENTION

The present invention relates to a connector and a connector assembly.

BACKGROUND

There is known a hermetically sealed connector in which a conductor and a housing are sealed with the connector serving as an electrical connection to a device, while preventing intrusion of air or moisture.

For example, Japanese Patent Publication JP 2003-179457A illustrates a connector in which a lead wire goes through a through hole provided in a base body. In this connector, surroundings of the lead wire in the through hole are filled with glass as a sealing material.

In the connector illustrated in Japanese Patent Publication JP 2003-179457A, for example, if a mating contact abuts on a side of the lead wire when being engaged with a mating connector, the lead wire is forced by the mating contact in a direction in which the lead wire is inclined. The lead wire is subjected to the force in the direction in which the lead wire is inclined and, thus, this force is conducted to the glass and the glass may be damaged.

SUMMARY

The present invention has been made in view of the above circumstances and provides a connector and a connector assembly in which deterioration of sealing performance is prevented.

According to a first aspect of the present invention, a connector includes a housing having a through hole extending from a top surface of the housing facing the mating connector to a bottom surface of the housing and a pin contact, adapted for contact with a mating contact in the mating connector, extending through the through hole and protruding from the top surface of the housing. This connector also includes a sealing member entirely surrounding the pin contact in the through hole and a limitation member, fixed to the top surface of the housing in proximity to that portion of the pin contact protruding from the top surface of the housing, for applying a reaction force against a force experienced by the pin contact when contacting the mating contact in the mating connector to limit inclination of the pin contact when the pin contact contacts the mating contact in the mating connector.

Further, according to a second aspect of the present invention, a connector assembly includes a first connector having a cantilever pin contact and a second connector that mates with the first connector. The second connector has a housing having a through hole extending from a top surface of the housing facing the mating connector to a bottom surface of the housing a pin contact, adapted for contact with a mating contact in the mating connector, extending through the through hole and protruding from the top surface of the housing. The second also has a sealing member entirely surrounding the pin contact in the through hole and a limitation member, fixed to the top surface of the housing in proximity to that portion of the pin contact protruding from the top surface of the housing, for applying a reaction force against a force experienced by the pin contact when contacting the mating contact in the mating connector to limit inclination of the pin contact when the pin contact contacts the mating contact in the mating connector.

As described above, according to the present invention, a connector in which deterioration of sealing performance is prevented is obtained.

DETAILED DESCRIPTION OF THE EMBODIMENT(S)

Exemplary embodiments according to the present invention will be described with reference to the drawings.

Figure 1:
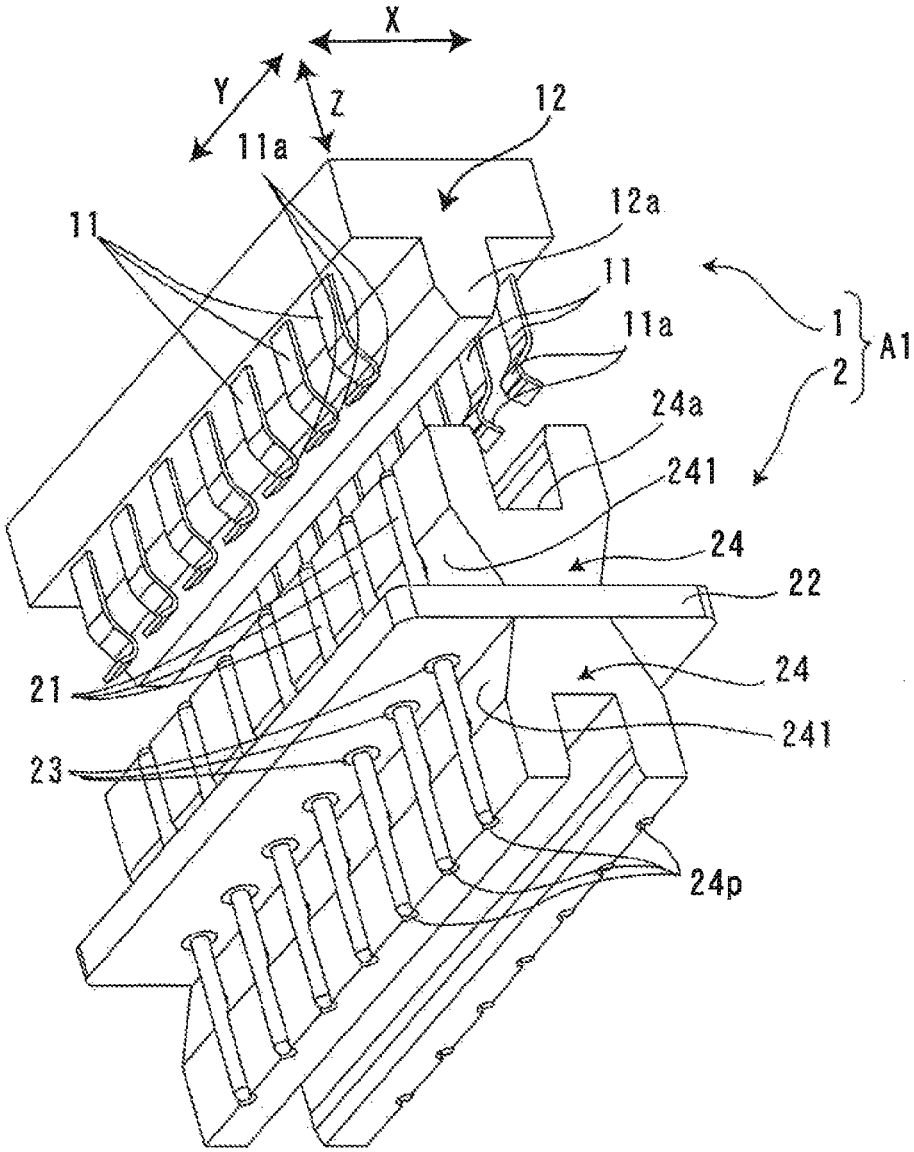
FIG. 1 is a perspective view illustrating a first embodiment of the connector assembly according to the present invention.
Figure 2:
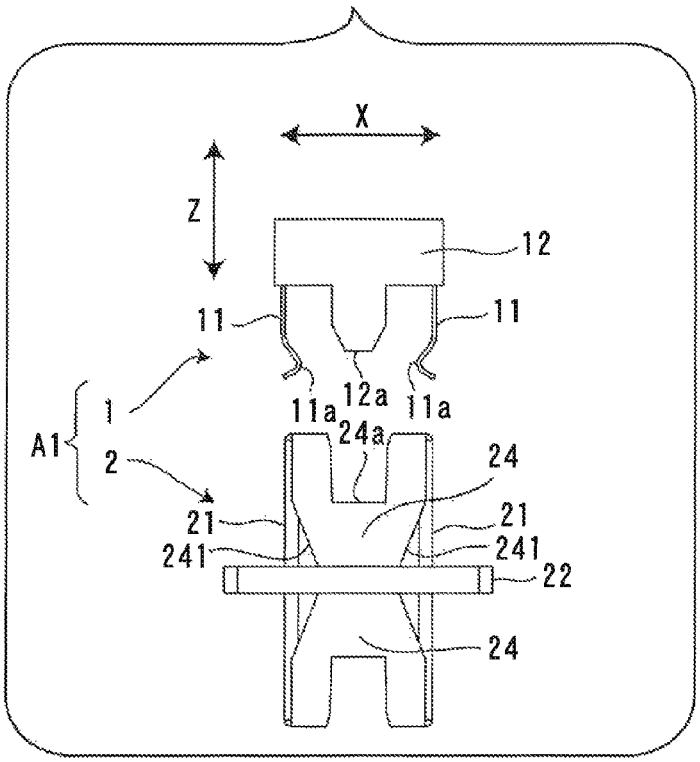
FIG. 2 is a side view illustrating the first embodiment of the connector assembly according to the present invention.

FIGS. 1 and 2 are views illustrating a first embodiment of the connector assembly according to the present invention. FIG. 1 is a perspective view and FIG. 2 is a side view.

The connector assembly A1, illustrated in FIGS. 1 and 2, includes a female connector 1 and a male connector 2. The female connector 1 and the male connector 2 are engaged with each other to be electrically connected. Here, the direction in which the female connector 1 and the male connector 2 are engaged is referred to as an engagement direction Z. In addition, the female connector 1 is an example of the first connector according to the present invention and the male connector 2 is an example of the second connector according to the present invention.

The female connector 1 includes spring contacts 11 and a housing 12. The housing 12 is formed of, for example, an insulating resin material. The female connector 1 and the male connector 2, according to the present embodiment, are 14-position electrical connectors and the female connector 1 includes fourteen spring contacts 11. Each of the spring contacts 11 is a leaf-type contact formed by stamping and forming an electrically conductive metal plate. The leaf-type contacts are held by the housing 12 in a cantilever manner and extend from the housing 12 in the engagement direction Z.

The fourteen spring contacts 11 are arranged in two rows. Each of the spring contacts 11 has a tabular shape and the spring contacts 11 are arranged in a row in the direction Y approximately perpendicular to an opposed direction X in which the two rows of the spring contacts 11 are opposed to each other. The spring contacts 11 elastically deform in the opposed direction X. Contact sections 11*a* are arranged at tip portions of the spring contacts 11 in the two rows with the tip sections extending from the housing 12. The contact section

11*a* are curved such that the contact sections 11*a* bulge toward each other along the opposed direction X. The opposed direction X, the row direction Y, and the engagement direction Z are approximately orthogonal to each other.

The housing 12 of the female connector 1 includes a protrusion 12*a* protruding in the engagement direction Z. The protrusion 12*a* is arranged between the two rows of the spring contacts 11 and extends along the row direction Y.

Figure 3:
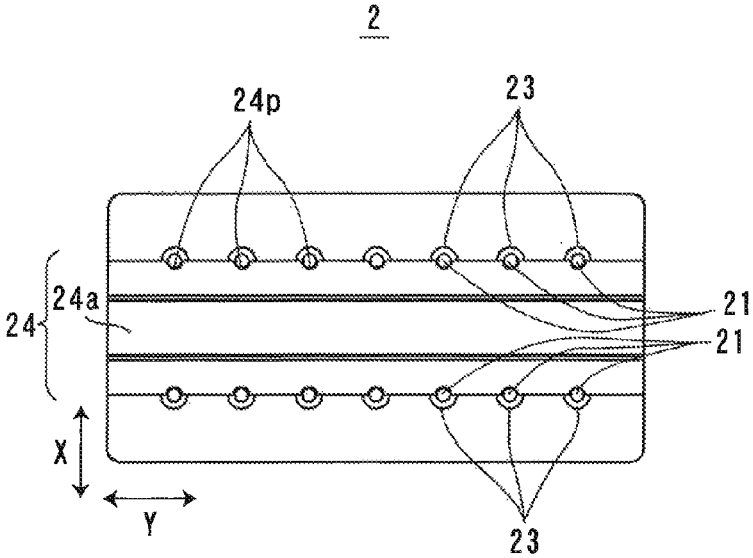
FIG. 3 is a plan view of the male connector illustrated in FIG. 1.
Figure 4:
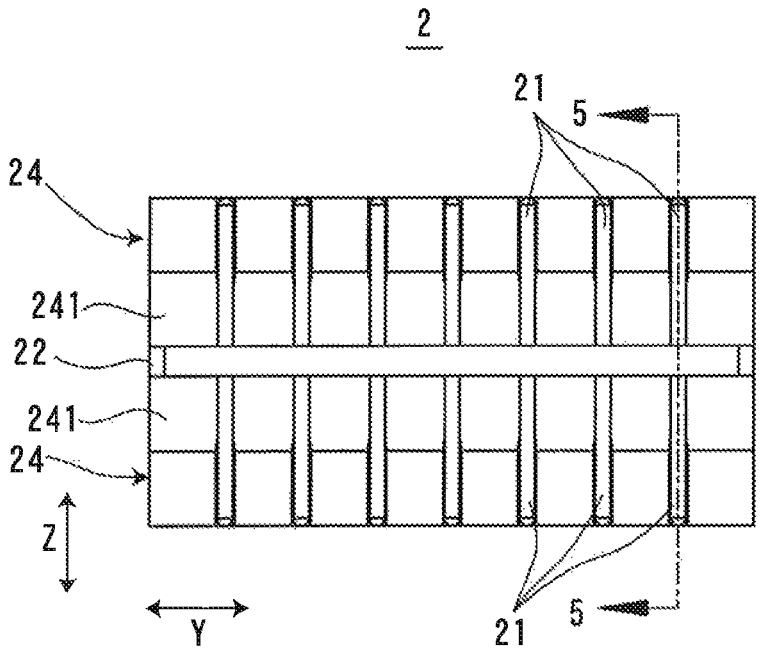
FIG. 4 is a front view of the male connector illustrated in FIG. 1.
Figure 5:
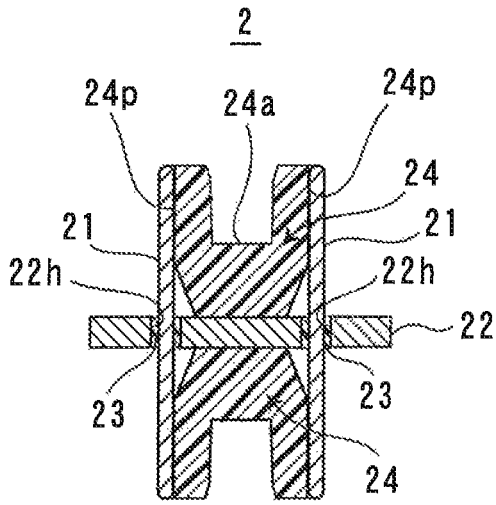
FIG. 5 is a sectional view of the male connector illustrated in FIG. 4, taken along the line 5-5 of FIG. 4.

FIG. 3 is a plan view of the male connector 2 illustrated in FIG. 1. In addition, FIG. 4 is a front view of the male connector 2. Further, FIG. 5 is a sectional view of the male connector 2 illustrated in FIG. 4, taken along the line 5-5. The male connector 2 will be described with reference to FIG. 1-5.

The male connector 2 includes pin contacts 21, a housing 22, sealing members 23, and the limitation members 24.

The male connector 2 includes fourteen contact pins 21. Each of the pin contacts 21 is a rod-shaped member made of a metal material. More specifically, each of the pin contacts 21 is a cylindrical rod extending in the engagement direction Z. The fourteen pin contacts 21 are arranged in two rows correspondingly to the spring contacts 11 of the female connector 1. When the female connector 1 and the male connector 2 are engaged with each other, the spring contacts 11 of the female connector 1 make contact with sides facing a side opposite to an adjacent row (hereinafter, referred to as outer side of row) of the pin contacts 21 arranged in two rows.

The housing 22 is a member supporting portions of the male connector 2. The housing 22 of the present embodiment is a tabular member. The housing 22 is formed of, for example, a metal material. When the male connector 2 is attached to a chassis of an electrical device (not illustrated), the male connector 2 is attached such that the male connector 2 closes a hole provided in the chassis (not illustrated). The housing 22 includes through holes 22*h* extending from a top to a bottom of the housing 22. The pin contacts 21 extend through the through holes 22*h* and protrude from both the top and the bottom of the housing 22. The diameters of the pin contacts 21 are less than the diameters of the through holes 22*h*.

The sealing members 23 seal the through holes 22*h* through which the pin contacts 21 extend. The sealing members 23 are formed of a glass material and fill the spaces between the pin contacts 21 and the through holes 22*h*. The sealing members 23 surround the entire periphery of the pin contacts 21 in the through holes 22*h* and fill the spaces between the inner walls of the through holes 22*h* and the pin contacts 21. Accordingly, the pin contacts 21 are supported by the housing 22 via the sealing members 23.

The male connector 2 of the present embodiment is a glass hermetic seal connector in which the spaces of the through holes 22*h* through which the pin contacts 21 extend are filled with the sealing member 23 made of glass. For this reason, a high sealing performance, that is, the gastightness and the fluid tightness between the top and the bottom of the housing 22 is achieved.

The male connector 2 includes two limitation members 24. The male connector 2 of the present embodiment has a symmetrical configuration with respect to top and bottom and the two limitation members 24 have the same configurations. Thus, the descriptions will be made, focusing on one of the two limitation members 24.

The limitation member 24 is a member formed of an insulating resin material and extending along in the row direction Y. The limitation member 24 is fixed to the housing 22. The method of fixing is adhering. However, welding, press-fitting or the like also can be used. The limitation member 24 includes an engagement groove 24*a* for receiving the protrusion 12*a* of the housing 12 of female connector 1.

The limitation member 24 is positioned between and in proximity to the two rows in which the pin contacts 21 are arranged. The limitation member 24 is formed with grooves 24*p* which receive those portions of the pin contacts 21 which protrude from the housing 22. About half the circumference of each of those portions of the pin contacts 21 which protrude from the housing 22 is surrounded by each of the grooves 24*p*. The pin contacts 21 are arranged in the grooves 24*p* to be positioned in the row direction Y. The limitation member 24 can be formed so that the pin contacts 21 extend through and rest in grooves 24*p*, or are spaced from grooves 24*p*. If pin contacts 21 are spaced from grooves 24*p*, these spaces are so small that, when a pin contact 21 is inclined by being subjected to a force, the pin contact 21 immediately makes contact with the limitation member 24 that is in proximity to the pin contact.

In addition, the limitation member 24 has a shape that avoids making contact where the pin contact 21 makes contact with the sealing member 23. Specifically, the limitation members 24 have the shapes avoiding making contact with the through holes 22*h* and the sealing members 23. Specifically, the limitation member 24 has a shape avoiding making contact with the through holes 22*h* and the sealing members 23. More specifically, the limitation member 24 includes inclined surfaces 241 which are more away from the pin contact 21 as the inclined surfaces approach the housing 22. Thus, even in a case in which the dimension of the limitation member 24 in the opposed direction X becomes larger than a distance between the pin contacts 21 arranged in the two rows, resulting from a tolerance, the thermal expansion, or the like at the time of producing, the shape and dimensions of the limitation member protect against application of a large force to the base sections where the pin contacts 21 are in contact with the sealing members 23. Accordingly, damage to the sealing members 23 is avoided.

When the female connector 1 and the male connector 2 illustrated in FIG. 2 are engaged, the protrusion 12*a* of the housing 12 in the female connector 1 enters the engagement groove 24*a* of the limitation member 24 in the male connector 2. In addition, the contact sections 11*a* of the spring contacts 11 make contact with the sides of the pin contacts 21. When the female connector 1 and the male connector 2 are engaged, the spring contacts 11 arranged in the two rows are deformed outwardly in the opposed direction X, and the contact sections 11*a* are pressed against the sides of the pin contacts 21 by elastic forces. Thus, contacting is made secure. On the other hand, the pin contacts 21 are subjected to forces from the spring contacts 11 toward the limitation member 24. In other words, the spring contacts 11 press the pin contacts 21 against the limitation member 24. The limitation member 24, in turn, applies to the pin contacts 21 reaction forces against the forces from the spring contacts 11 to limit inclination of the pin contacts 21. Since the limitation member 24 includes the inclined surfaces 241, the limitation member 24 applies, more specifically, the reaction forces to portions nearer the tips than the base sections of the pin contacts 21 which base sections make contact with the sealing members 23. In other words, the reaction forces are applied to the pin contacts remote from the sealing members 23.

Since the inclination of the pin contacts 21 are limited by the limitation member 24, prying by the pin contacts 21 does not result. Accordingly, damage and peeling of the sealing members 23 that might otherwise occur from prying the pin contacts 21 and would result in deterioration of the sealing performance in the male connector 2 is prevented.

Next, a second embodiment according to the present invention will be described. In the descriptions of the second embodiment in the following, elements same as those in the embodiment described above are respectively provided with the same signs, and differences from the above-described embodiment will be described.

Figure 6:
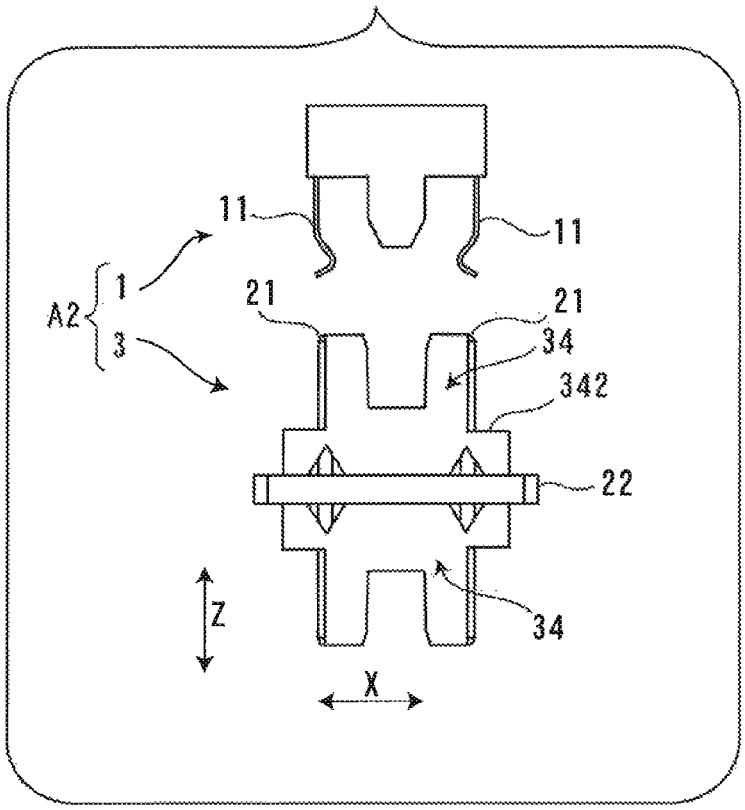
FIG. 6 is a side view illustrating a second embodiment the connector assembly according to the present invention.
Figure 7:
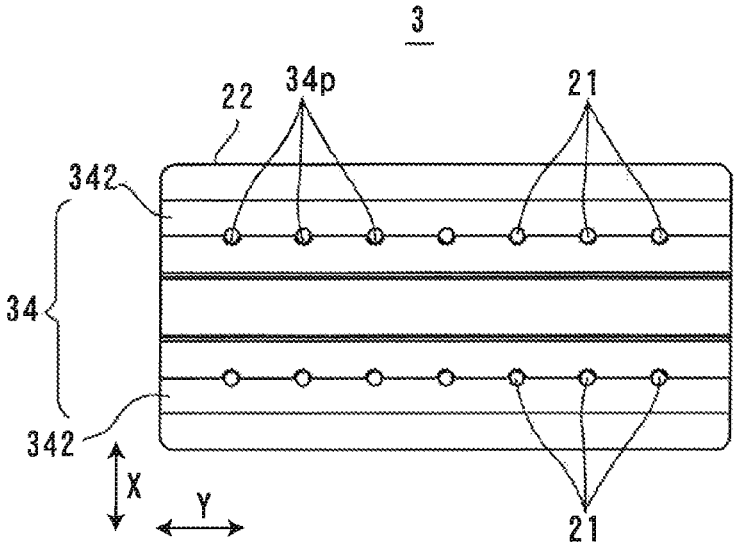
FIG. 7 is a plan view of the male connector illustrated in FIG. 6.
Figure 8:
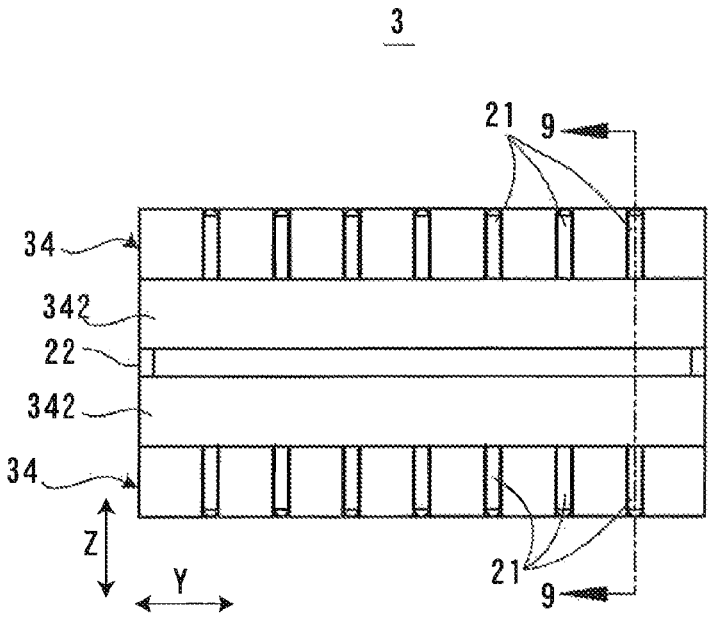
FIG. 8 is a front view of the male connector illustrated in FIG. 6.
Figure 9:
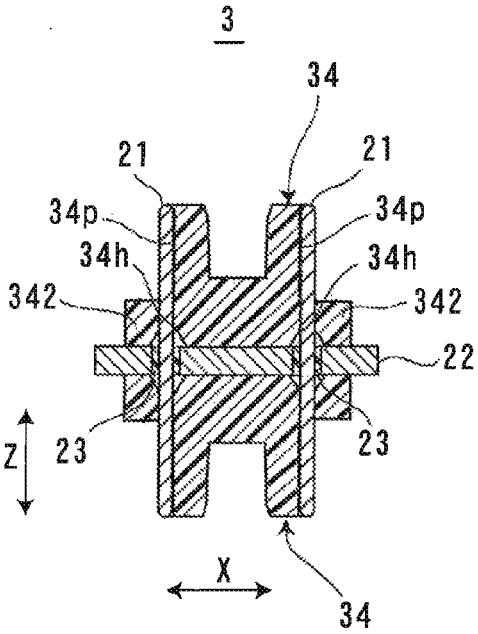
FIG. 9 is a sectional view of the second connector illustrated in FIG. 8, taken along the line 9-9 of FIG. 8.

FIG. 6 is a side view illustrating a connector assembly of the second embodiment. In addition, FIG. 7 is a plan view illustrating the male connector illustrated in FIG. 6. FIG. 8 is a front view illustrating the male connector. Further, FIG. 9 is a sectional view of the second connector illustrated in FIG. 8, taken along the line 9-9 of FIG. 8.

A connector assembly A2 illustrated in FIG. 6 is different from the connector assembly A1 of the first embodiment in the configuration of a male connector 3. In addition, the male connector 3 illustrated in FIGS. 6-9 is different from the male connector 2 of the first embodiment in the shape of the limitation members 34.

The limitation members 34 in the second embodiment have shapes surrounding the entire periphery of those portions of the pin contacts 21 which protrude from the housing 22. Specifically, the limitation members 34 include extension sections 342 expanded outside the two rows formed by the pin contacts 21. The height of the expansion sections 342 in the engagement direction Z are smaller than the height of those portions of the housing inside the two rows formed by the pin contacts 21. For this reason, the sides nearer to the tips of the pin contacts 21 are exposed outside over the expansion sections 342 and make contact with the spring contacts 11 of the female connector 1.

The limitation members 34 including the expansion sections 342 are provided with holes 34*h* through which the pin contacts 21 extend. The holes 34*h* are linked to grooves 34*p* arranged similarly to the first embodiment. The pin contacts 21 extend through the holes 34*h* of the limitation members 34 to be surrounded entirely by the limitation members 34.

Accordingly, in the male connector 3 of the present embodiment, for example, even in a case in which the pin contacts 21 bump against another object and an outward force is unexpectedly applied to the pin contacts 21, the inclination of the pin contacts 21 are limited. Accordingly, since damage and a peeling of the sealing members 23 are avoided, deterioration of the sealing performance in the male connector 3 is prevented.

In the above-described embodiments, the male connectors 2 and 3, having the symmetrical configuration with respect to top and bottom, are described as examples of the second connector according to the present invention. However, the second connector according to the present invention is not limited to this and, for example, one side of the housing may not be provided with the limitation member. In addition, the tips of the pin contacts may have, for example, shapes for soldering.

In addition, in the above-described embodiments, the leaf-type contacts are described as examples of the first contacts according to the present invention. However, the present invention is not limited to this. The contacts may be, for example, a bellows-type contact which is bent to meander.

In addition, in the above-described embodiments, the cylindrical rods are described as examples of the contact or the second contact according to the present invention. However, the present invention is not limited to this. The contacts may be, for example, squared rods.

In addition, in the above-described embodiments, the contacts arranged in the two rows are described as examples of the first contacts and the second contacts according to the present invention. However, the present invention is not limited to this. The contacts may be, for example, arranged in single row. In addition, the number of the contacts may be 13 or less or 15 or more.

Further, in the above-described embodiments, the housing 22 having the tabular shape and being made of a metal material is described as examples of the housing according to the present invention. However, the present invention is not limited to this. The housing may be formed of, for example, a resin material and, in addition, may have a shape surrounding the contacts.

Furthermore, in the above-described embodiments, the sealing members 23, being made of glass and being applied in the through holes 22*h*, are described as examples of the sealing member according to the present invention. However, the present invention is not limited to this. The sealing member may have, for example, a shape surrounding the contacts outside the through holes. In addition, the sealing member may be made of a resin material.

What is claimed is:

1. An electrical connector adapted for an electrical connection to a mating connector and comprising:

a housing having a through hole extending from a top surface of the housing facing the mating connector to a bottom surface of the housing;

a pin contact, adapted for contact with a mating contact in the mating connector, extending through the through hole and protruding from the top surface of the housing;

a sealing member entirely surrounding the pin contact in the through hole; and a limitation member, fixed to the top surface of the housing in proximity to that portion of the pin contact protruding from the top surface of the housing, for applying a reaction force against a force experienced by the pin contact when contacting the mating contact in the mating connector to limit inclination of the pin contact when the pin contact contacts the mating contact in the mating connector.

2. The connector according to claim 1, wherein the reaction force applied to the pin contact by the limitation member is applied to the pin contact remote from the sealing member.

3. The connector according to claim 1, wherein the limitation member has a groove through which the pin contact extends.

4. The connector according to claim 3, wherein the pin contact rests in the groove in the limitation member.

5. The connector according to claim 1, wherein the limitation member has a hole through which the pin contact extends.

6. The connector according to claim 2, wherein the limitation member has a hole through which the pin contact extends.

7. An electrical connector assembly comprising:

a first connector having a cantilever pin contact; and a second connector mating with the first connector and includes (a) a housing having a through hole extending from a top surface of the housing facing the first connector to a bottom surface of the housing, (b) a pin contact in contact with the cantilevered pin contact when the first connector is mated to the second connector, extending through the through hole and protruding from the top surface of the housing;

(c) a sealing member entirely surrounding the pin contact in the through hole, and (d) a limitation member, fixed to the top surface of the housing in proximity to that portion of the pin contact protruding from the top surface of the housing, applying a reaction force against a force experienced by the pin contact when the pin contact is in contact with the cantilevered pin contact, to limit inclination of the pin contact.

8. The connector according to claim 7, wherein the reaction force applied to the pin contact by the limitation member is applied to the pin contact remote from the sealing member.

9. The connector according to claim 7, wherein the limitation member has a groove through which the pin contact extends.

10. The connector according to claim 9, wherein the pin contact rests in the groove in the limitation member.

11. The connector according to claim 7, wherein the limitation member has a hole through which the pin contact extends.

12. The connector according to claim 8, wherein the limitation member has a hole through which the pin contact extends.

* * * * *